United States Patent [19]

Tasato

[11] 4,147,077

[45] Apr. 3, 1979

[54] ADJUSTABLE LOCKING WRENCH

[76] Inventor: Noboru Tasato, 57 Asato, Naha, Okinawa, Japan

[21] Appl. No.: 845,324

[22] Filed: Oct. 25, 1977

[30] Foreign Application Priority Data

Nov. 2, 1976 [JP] Japan ..... 51-131225

[51] Int. Cl.[2] ..... B25B 7/12

[52] U.S. Cl. ..... 81/367; 81/373

[58] Field of Search ..... 81/367–380

[56] References Cited

U.S. PATENT DOCUMENTS

| | | | |
|---|---|---|---|
| 2,524,689 | 10/1950 | Westman | 81/378 |
| 2,769,359 | 11/1956 | Healy | 81/376 |
| 3,192,804 | 7/1965 | Petersen et al. | 81/370 |
| 3,314,319 | 4/1967 | Schmidt | 81/367 |

FOREIGN PATENT DOCUMENTS

| | | | |
|---|---|---|---|
| 1330492 | 9/1973 | United Kingdom | 81/370 |

*Primary Examiner*—James L. Jones, Jr.

*Attorney, Agent, or Firm*—Oldham, Oldham, Hudak & Weber

[57] ABSTRACT

In a locking wrench designed to grip an object between a stationary and a movable jaw firmly under the action of a toggle link associated at one end with the movable jaw and at the other end with a threaded bolt, the movable jaw is divided into two separate parts, that is, a body member pivotally secured to the stationary jaw and a grip member supported on the body member for sliding movement relative thereto so that the distance between the grip faces of the grip member and the stationary jaw may be adjusted as desired. With this structure, an optimum force of grip is readily obtainable at all times for thickness of the object to be gripped without the need of adjusting the threaded bolt therefor.

2 Claims, 9 Drawing Figures

ADJUSTABLE LOCKING WRENCH

BACKGROUND OF THE INVENTION

Locking wrenches or pliers have been commercially available, for example, under the name of "hand vice" and are generally of the structure including a tool body formed rigid with a stationary jaw, a movable jaw pivotally connected with the tool body for movement toward and away from the stationary jaw, an operating handle pivotally secured at its basal end to the movable jaw, an adjusting bolt threadably fitted to the tool body, and a toggle link pivoted at its inner, operating end to the operating handle and bearing at the other end against the inner end of the adjusting bolt. In use, when the operating handle is gripped by hand together with the tool body after the movable jaw has been adjusted by operation of the adjusting bolt into an appropriate position relative to the stationary jaw for thickness of the object to be gripped therebetween, the toggle link is laterally forced so as to be compressed between the adjusting bolt and the operating lever, to which the toggle link is pivoted, as will be described later in more detail, so that the stationary and movable jaws are urged toward each other to firmly grip the object.

This type of wrench is highly valued for its extraordinarily large force of grip but involves a disadvantage that a troublesome bolt-adjusting operation is required each time the thickness of the object to be gripped changes. In addition, if mishandled, its force of grip might be excessively increased to cause jaw breakage. This incurs a serious danger particularly in cases where the tool is used at levels high above the ground.

SUMMARY OF THE INVENTION

The present invention is intended to overcome the disadvantages previously involved as described above and has for its object the provision of a new and improved locking wrench of the type described which is capable of gripping an object at all times with an optimum pressure without the trouble of adjusting the threaded bolt each time for thickness of the object to be gripped.

Another object of the present invention is to provide a locking wrench of the type described which can be readily adjusted for thickness of the object to be gripped simply by the thumb of the hand gripping the tool handles, thus leaving the other hand free to handle the object to be gripped.

A further object of the present invention is to provide a locking wrench of the type described which is free from the danger previously involved that the jaw or jaws be broken and drop down as the result of inappropriate bolt adjustment.

To attain these objects, the present invention proposed to form the movable jaw in two separate parts, namely, a rockable member pivotally secured to one of the tool handles which is rigid with the stationary jaw and an adjustable jaw member slidably supported on the rockable member in a position opposite to the stationary jaw, and to provide on the rockable member gap-adjusting means operable to move the adjustable jaw member toward and away from the stationary jaw.

The above and other objects, features and advantages of the present invention will become apparent from the following description when taken in conjunction with the accompanying drawings.

DESCRIPTION OF THE PREFERRED EMBODIMENTS

Figure 1:
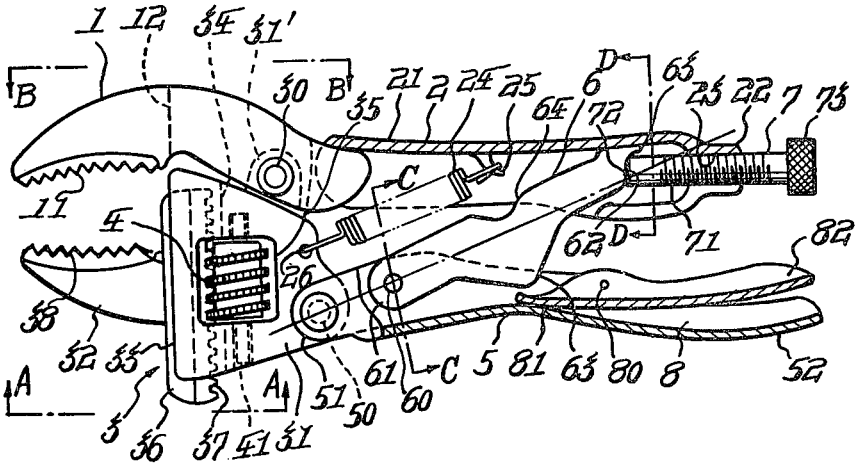
FIG. 1 is a side view of one preferred embodiment of the present invention, showing the handles in cross section.

Referring to the drawings and first to FIG. 1, which illustrates a preferred embodiment of the invention, reference numeral 1 indicates a stationary jaw rigidly secured, as by welding, to the inner, basal end 21 of a tool body 2 which is substantially of U-shape in cross section, serving as one of a pair of grip handles of the wrench.

Figure 1A:
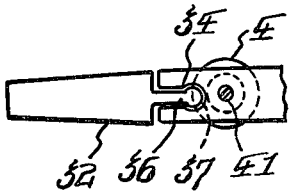
FIGS. 1*a* and 1*b* are fragmentary plan views of the embodiment, looking in the direction of the lines A—A and B—B, respectively, in FIG. 1.

Reference numeral 3 generally indicates a movable jaw unit formed according to the present invention and consisting of a rockable member 31 pivotally secured at one corner thereof to the stationary jaw 1 by means of a first pivot 30 provided at a point adjacent to the inner, basal end of the stationary jaw and an adjustable jaw member 32 slidably supported on the rockable member 31 in a position opposite to the stationary jaw 1. The jaw member 32 is adjustable in distance from the stationary jaw 1, as will be described below in detail. The rockable member 31 is formed in its forward, jaw-carrying edge 33 with a guide groove 34 which lies along a straight line extending from a point adjacent to the inner end of the toothed grip face 11 of stationary jaw 1 substantially at right angles thereto. As clearly seen in FIG. 1*a*, the guide groove 34 is formed with a cylindrical enlarged bottom, thus having a keyhole-like cross section. The rockable member 31 is formed with a rectangular window opening 35 having a pair of opposite sides parallel to the forward edge 33 of the rockable member 31. The window opening 35 communicates with the guide groove 34 at its cylindrical enlarged bottom, extending transversely through the rockable member 31. In the window opening 35, a worm 4 is rotatably supported on a threaded shaft 41 which is fitted at the opposite ends to the end walls of the window opening 35 and extends parallel to the forward edge 33 of the rockable member 31.

Figure 1B:
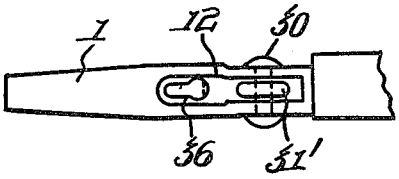

The adjustable jaw member 32 is formed at its inner, basal end with an integral sliding portion 36 which is extended both upwardly and downwardly beyond the body portion of the jaw member 32 substantially at right angles to the grip face 38 thereof. As clearly seen in FIG. 1*a*, the sliding portion 36 is keyhole-shaped in cross section, having a cylindrically enlarged edge, and is slidably fitted in the guide groove 34, which is formed along the forward edge of the rockable member 31. The enlarged edge of the sliding portion 36 is formed thereon with rack teeth 37 which present themselves into the window opening 35 for meshing engagement with the worm 4 rotatably supported therein. As shown in FIGS. 1 and 1*b*, the stationary jaw 1 is formed with a through aperture 12 to allow the sliding portion 36 to advance partly therein. In the illustrated embodiment, the through aperture 12 is extended to accommodate the bearing lug 31' formed on the rockable member 31 for pivotal engagement with the first pivot 30 referred to above.

Further, the rockable member 31 is provided with a second pivot 50 at a location defining a triangle together with the first pivot 30 and the adjustable jaw member 32. The other gripping handle 5 of the wrench is pivotally mounted at its inner or basal end 51 on the second pivot 50 and serves as an operating handle of the tool.

Figure 1C:
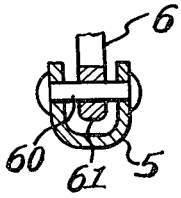
FIGS. 1*c* and 1*d* are cross-sectional views taken along the lines C—C and D—D, respectively, in FIG. 1.
Figure 1D:
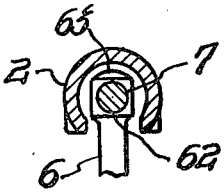

The operating handle 5, preferably made of sheet metal, is U-shaped in cross section particularly in the end region of pivotal connection with the rockable member 31, as clearly seen in FIG. 1*c*, and carries a third pivot 60 on which a toggle link 6 of a predetermined length is mounted at its inner, actuating end 61. As seen in FIG. 1, the third pivot 60 is located at a point slightly spaced from the second pivot 50, provided at the basal end of the operating handle 5, in a direction toward the grip end 52 of the handle.

Referring again to FIG. 1, the tool body 2 is reduced at its grip end into a tubular configuration 22, which is internally threaded to define a threaded aperture 23, in which an adjusting bolt 7 including an externally threaded shank portion 71 and an enlarged head portion 73 is threadably fitted. As shown, the toggle link 6 is formed at its outer end with an abutting face 62 wich bears against the inner end of the adjusting bolt 7.

In FIG. 1, reference numeral 24 indicates a coiled tension spring anchored at one end on a lug 25 formed on the tool body 2 and hooked at the other end into an aperture 26 formed in the rockable member 31. As will readily be noted, the tension spring 24 normally urges the rockable member 31 to turn about the axis of the first pivot 30 in a counterclockwise direction, as viewed in FIG. 1. The biasing force of the tension spring acts through the second pivot 50 and third pivot 60 upon the toggle link 6 so that the abutting face 62 of the latter is held pressed against the inner end 72 of adjusting bolt 7. Reference numeral 63 indicates a tongue formation provided on the outer end of toggle link 6 to make sure the engagement of the abutting face 62 with the tip end of adjusting bolt 7.

Intermediate the ends of operating handle 5 is arranged a releasing lever 8 which is pivotally mounted in the hollow channel of the handle 5 by pin means provided 80 at a point close to the inner, actuating end 81 of the lever 8. The toggle link 6 is formed at a point opposite to the actuating end 81 of the releasing lever 8 with a downward projection 63. Reference numeral 64 indicates a recess formed in the toggle link 6 to clear the spring anchor or lug 25. The actuating end 81 of releasing lever 8 is so shaped that it may come into bearing engagement with the bottom surface of the U-channel formed in the operating handle 5. In the state of the releasing lever 8 with its actuating end 81 bearing against the channel bottom of operating handle 5, the operating portion or the other end portion 82 of releasing lever 8 is held more or less spaced from and substantially in parallel with the grip end portion 52 of operating handle 5, which is made rather flat, as shown in FIG. 1. Owing to such configuration of the releasing lever 8, its actuating end 81 is thrusted upwardly a substantial distance as the lever is turned about the axis of pin 80 in a clockwise direction, as viewed in FIG. 1, when the operating portion 82 of the releasing lever 8 is pushed toward the grip end of the operating handle until if comes practically into close contact with the channel bottom of the operating handle. The relationship between the projection 63 on the toggle link 6 and the releasing lever 8 will be explained later.

Figure 2:
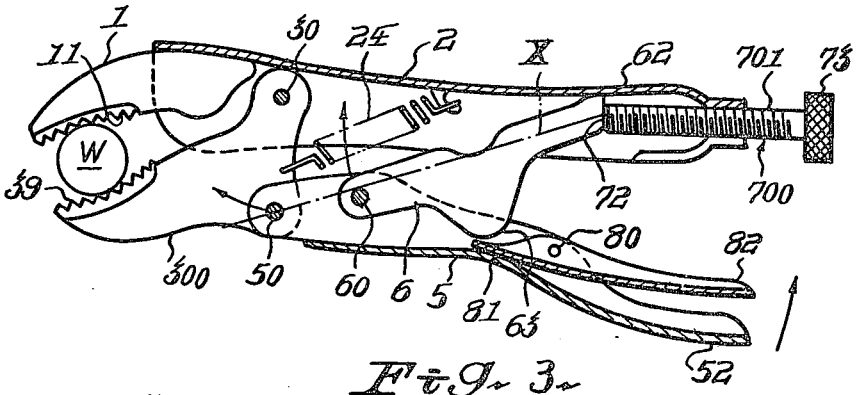
FIG. 2 is a view similar to FIG. 1 of a conventional form of locking wrench.

Preliminary to describing the operation and functional effects of the locking wrench constructed and arranged according to the present invention as described above, those of a conventional locking wrench will next be described with reference to FIGS. 2, 3 and 4, in which the same references have been used as in FIG. 1 for similar parts having the same functions.

The conventional locking wrench is dissimilar to the one of the present invention in that the movable jaw 300 of the former is a one-piece solid member unlike that of the latter which is divided into two parts, i.e., a rockable member and an adjustable jaw member, and that the threaded bolt 700 of the former serves the purpose different from that of the adjusting bolt 7 of the latter in use of the tool.

The movable jaw 300 is mounted on the first pivot 30 for pivotal movement about the axis thereof and has a grip face 39 formed at such a point as to define a triangle together with the first pivot 30 and second pivot 50. The threaded adjusting bolt 700 is externally threaded substantially over the whole length thereof, as indicated at 701, to serve the adjusting function and is formed at its outer end with a finger grip or knurled head 73. The threaded bolt 700 is adjusted in the direction A-B of its axis (FIG. 3) manually by means of the knurled head 73 each time the tool is used.

The remaining parts of the conventional wrench are equivalent to those of the one shown in FIG. 1 and any description of their structure is believed to be unnecessary.

Description will next be made of the operation of the conventional wrench with reference to FIG. 3, which is partly schematic, illustrating the wrench structure with the releasing lever 8 omitted. In FIG. 3, reference character C indicates the point of contact between the inner end 72 of threaded adjusting bolt 701 and the abutting face 62 of toggle link 6, which is normally biased outwardly under the tension S of coiled spring 24, thus tending to shift the contact point C outwardly in the direction B of the bolt axis A-B. If drawn out over a substantial distance, the contact point C is shifted correspondingly, for example, to point Ca with the result that the movable jaw is widely swung open, as indicated by the dottled line 300*a*. Simultaneously with this, the operating lever 5 is widely swung open, as indicated by the dotted line 5*a*, with the aid of a now arising component of spring tension S which acts to urge the third pivot 60 outwardly downwardly. Reference numeral 60*a* indicates the axis position of the third pivot shifted in this manner.

In order to grip an object W with this locking wrench, the handles are gripped by one hand with the object held in place between the jaws by the same hand and, in this condition, the knurled head 73 of the adjusting bolt is turned by the other hand to shift the contact point C in the direction A so that the second pivot is pushed forward through the intermediary of toggle link 6, third pivot 60 and operating handle 5. As the contact point reaches the point C in FIG. 3, the movable jaw 300, operating handle 5, and toggle link 6 are respectively positioned as indicated in FIG. 3 by the solid lines. In this state, the third pivot 60 is in a position slightly outside of the line X—X passing through the axis of second pivot 50 and the contact point C, or on that side of the line X—X which is remote from the tool body or handle 2, against the above-referred-to component force of tension spring 24.

It is to be noted that this form of locking wrench requires some knack in use since the contact point C needs to be properly set each time by adjusting the threaded bolt 700 axially thereof so that the object W may be clamped under an appropriate pressure by an ordinary manual grip on the tool handles. Preferably, the contact point C is so set that the third pivot 60 is placed slightly outside of the line X—X.

The projection 63 on the toggle link 6 is formed with such a height that, in the tool state adjusted as described above, there remains only a limited distance between the projection 63 and the actuating end 81 of releasing lever 8 as bearing against the inside wall surface of operating handle 5 at a point opposite to the projection 63.

Subsequently, the manual grip on the operating handle 5 is slightly intensified to urge it counterclockwise about the axis of second pivot 50 so that the third pivot 60 is shifted upwardly across the line X—X. The projection 63 is brought into collision with the actuating end 81 of the releasing lever when the third pivot is displaced into a position **60*b*** slightly inside of the line X—X and any further movement of the operating lever is prevented.

The inward displacement of the third pivot 60 in effect produces a toggle force urging the movable jaw into a position such as indicated by the dotted line **300*b*. This force acts to compress the toggle link 6 between the third pivot 60** and the contact point C on account of the object W gripped between the jaws while at the same time serving to press the movable jaw against the object W. As will readily be recognized, this force is so enormous that a gripping force of one ton or over can be easily obtained on the object.

The object thus gripped can readily be released by pulling the operating portion 82 of releasing lever 8 toward the grip end of the operating handle 5. Though the compressive force acting through the toggle link 6, with the third pivot 60 lying inside the line X—X in FIG. 3 (line X in FIGS. 2 and 4), and urging the operating handle 5 counterclockwise about the axis of second pivot 50 has a component which acts to press the top of projection 63 against the inside wall surface of the operating handle through the medium of the actuating and 81 of the releasing lever, the above-described operation of the lever 8 causes the actuating end 81 to push the projection 63 away from the inside wall surface of the operating handle against the above-referred-to component of the compressive force acting through the toggle link 6. As the consequence, the operating handle is opened under the outward thrust acting on pin 80, carrying the third pivot 60 to the outside of line X—X, and thus the movable jaw 300 is swung open to release the object.

Figure 3:
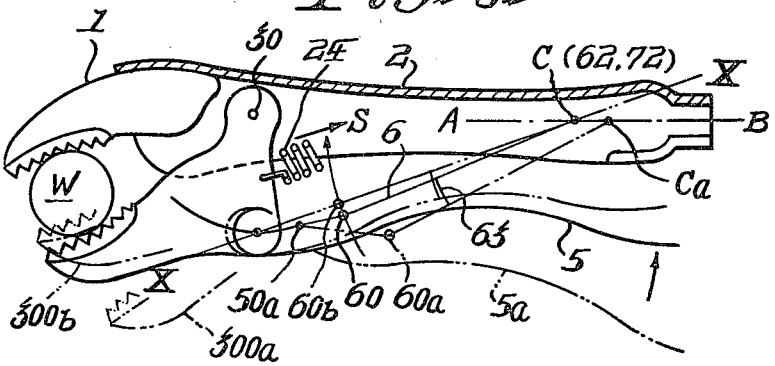
FIG. 3 is a partly schematic side elevation of same, drawn to explain the principles of operation thereof.
Figure 4:
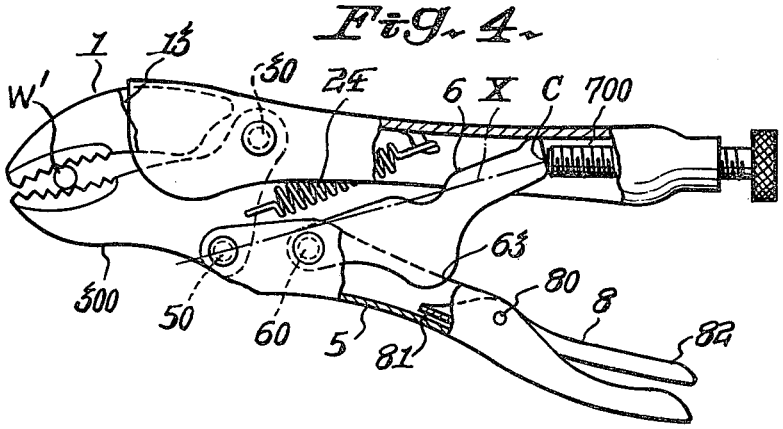
FIG. 4 is a view similar to FIG. 2, showing the conventional wrench in a state gripping an object of different thickness.

If the object to be gripped is of smaller thickness, as indicated at W' in FIG. 4, the threaded bolt 700 is further advanced axially inward to shift the set position of the contact point C in the direction A in FIG. 3.

If the threaded bolt is driven forward with the operating handle gripped quite hard together with the tool body, if may happen that the contact point C is set at a point such that the third pivot 60 is positioned at a substantial distance from the line X, as will be seen from FIG. 4.

In such event, if the grip on the end 52 of operating handle 5 be further increased, the third pivot must be displaced inwardly over a considerable distance in order to be set at a position inside of the line X and the toggle link be subjected to an excessively large compressive force, possibly causing the stationary jaw 1 to break. Line 13 in FIG. 4 indicates the location of fracture usually occurring in the stationary jaw.

It is to be noted that the conventional locking wrench has an inconvenience that it cannot be operated one-handed in gripping an object, requiring a rather troublesome operation of setting the threaded bolt in an appropriate position with one hand while adjusting the strength of grip of the other hand on the tool handles, as described above. Also, each time the object to be gripped changes, the threaded bolt must be set a new. If jaw breakage should occur in operation at any high level, broken jaw pieces and the object being gripped may fall to cause some unforeseen accident, not to speak of the loss of the tool.

The locking wrench of the present invention is designed to overcome all the difficulties previously encountered as described above.

Referring again to FIG. 1, the adjusting bolt 7 is adjusted in advance so as to be set in a position such that, when the rockable member 31 is placed to make the grip face 38 of adjustable jaw 32 substantially parallel to the grip face 11 of stationary jaw 1, the axis of third pivot 60 assumes a position slightly outside of the line X at an appropriate distance therefrom, with the outer end 62 of toggle link 6 abutting against the inner end of adjusting bolt 7. Once the adjusting bolt 7 has been set as described above, the tool is held as a whole in the state in FIG. 1 under the effect of tension spring 24.

To grip an object with the locking wrench of the invention, the tool handles are lightly gripped together by one hand and the worm 4 is turned by the ball of the thumb to move the adjustable jaw inwardly against the object placed between the jaws until the object is clamped in place under an appropriate pressure. Such operation can readily be performed one-handed. Subsequently, the grip on the tool handles is strengthened to displace the third pivot 60 inwardly across the line X thereby to compress the toggle link. By doing this, a very large gripping pressure is obtained on the object, as with the case of the conventional tool. The manner in which the releasing lever 8 functions is obviously the same as with the conventional tool.

It is to be noted at this point that the external threads 71 provided on the adjusting rod of the locking wrench of the present invention is intended to enable slight adjustment of the force of grip on the object being gripped while making the adjusting bolt engageable with the tool body and not to make it possible to change the set position of the adjusting bolt each time the object to be gripped changes in size as required with the case of the conventional form of locking wrench. It will be apparent that the thread formation 71 makes it possible to compensate for any slackening of grip force as may result from wear of the pivots.

Figure 5:
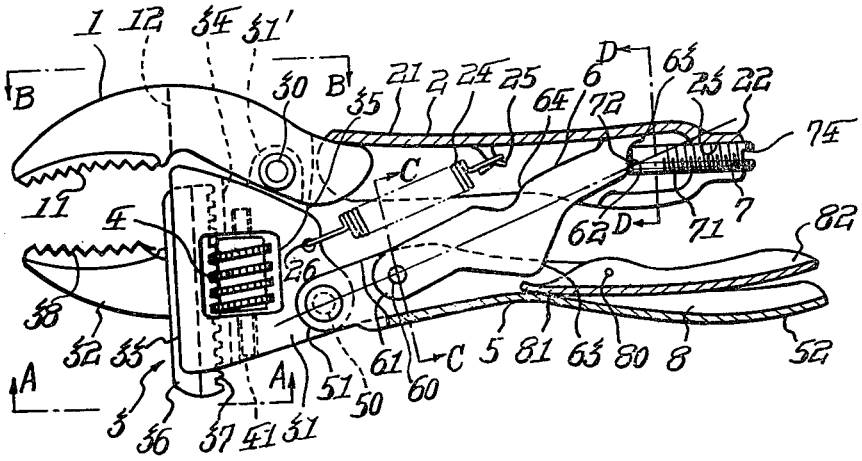
FIG. 5 is a side view, partially in section, of the modified form of the article of the invention.

Further, in the locking wrench of the present invention, as the threaded adjusting bolt 7 is not intended to be operated at all times, as described above, the finger grip or knurled head 73 thereof shown in FIG. 1 may be omitted, and the threaded bolt may, instead, have an outer end just cut across and be formed in the end face with a slot for receiving a plus or minus type screw driver as shown at 74 in FIG. 5.

What is claimed is:

1. A locking wrench of the type including a body member (2) formed integral with a stationary jaw (1), movable jaw unit (3) pivotally secured to said stationary jaw at a point adjacent to the basal end thereof by means of a first pivot (30), an operating handle (5) pivotally secured at the basal end (51) thereof to said movable jaw unit by means of a seond pivot (50) provided thereon at a point to define a triangle together with said first pivot and the grip face of said movable jaw unit, a third pivot (60) provided on said operating handle at a point adjacent to said second pivot (50), an adjusting bolt (7) threadably fitted to the grip end of said body member, a toggle link (6) of a predetermined length pivotally mounted at the operating end (61) thereof on said third pivot (60) and abutting at the other end (62) against the inner end of said adjusting bolt, said toggle link being formed with a lateral projection (63) intermediate the end thereof, and a toggle-releasing lever (8) pivotally mounted on said operating handle for pressure engagement with said lateral projection (63) on said toggle link, said locking wrench being characterized in that said movable jaw unit (3) consists of a rockable member (31) pivotally secured to said body member (2) by means of said first pivot (30) and pivotally connected with said operating handle (5) by means of said second pivot (50), an adjustable jaw member (32) supported on said rockable member for movement relative thereto, and gap-adjusting means (4) provided on said rockable member for moving said adjustable jaw member (32) toward and away from said stationary jaw (1); and said rockable member (31) being provided with a forward edge (33) extending in a plane intersecting said stationary jaw at a point adjacent to the inner end of the grip face (11) thereof substantially at right angles to the grip face in the normal state of the locking wrench, a guide groove (34) formed in said forward edge (33) lengthwise thereof and having a cylindrical enlarged bottom, and a window opening (35) extending through said rockable member transversely thereof and communicating with said guide groove (34), said adjustable jaw member (32) having a sliding portion (36) formed with a cylindrical enlarged edge extending substantially at right angles to the grip face (38) of said adjustable jaw member and slidably fitted in said guide groove (34), rack teeth (37) formed on said cylindrical enlarged edge and presenting themselves into said window opening (35), and a worm (40) rotatably supported in said window opening (35) in meshing engagement with said rack teeth.

2. A locking wrench as in claim 1 where said adjusting bolt 37 has an outer end protruding from the grip end of said body member and a slot is formed in said outer end for receiving a screw driver for axial adjustment of said adjusting bolt.

* * * * *